US005492456A

United States Patent [19]

Knight et al.

[11] Patent Number: 5,492,456

[45] Date of Patent: Feb. 20, 1996

[54] FAN MOTOR/IMPELLER MOUNTING SYSTEM

[75] Inventors: John T. Knight, Fort Smith; Jeffrey L. Lyons, Greenwood; Diane M. Jakobs, Alma, all of Ark.

[73] Assignee: Rheem Manufacturing Company, New York, N.Y.

[21] Appl. No.: 298,222

[22] Filed: Aug. 29, 1994

[51] Int. Cl.[6] ..... F04B 53/16

[52] U.S. Cl. ..... 417/360; 417/363; 417/423.15; 248/604

[58] Field of Search ..... 417/360, 363, 417/423.15; 415/213.1, 119; 248/603, 604

[56] References Cited

U.S. PATENT DOCUMENTS

| | | | |
|---|---|---|---|
| 1,863,043 | 6/1932 | Johnson . | |
| 1,873,343 | 8/1932 | Seyfried | 248/604 |
| 2,030,565 | 2/1936 | Bilde . | |
| 2,451,970 | 10/1948 | Odor . | |
| 2,881,995 | 4/1959 | Neher . | |
| 2,926,837 | 3/1960 | Coe . | |
| 2,936,947 | 5/1960 | Staak | 417/363 |
| 2,975,960 | 3/1961 | Atalla . | |
| 3,830,595 | 8/1974 | Carpenter et al. . | |
| 4,076,197 | 2/1978 | Dochterman | 417/363 |
| 4,155,529 | 5/1979 | Maudlin . | |
| 4,200,257 | 4/1980 | Litch, III | 417/363 |
| 4,253,634 | 4/1981 | Daniels | 248/604 |
| 4,572,472 | 2/1986 | Eder . | |
| 4,636,673 | 1/1987 | McDonald | 417/363 |
| 4,759,526 | 7/1988 | Crawford et al. | 248/604 |
| 4,805,868 | 2/1989 | Claude . | |

FOREIGN PATENT DOCUMENTS

| | | | |
|---|---|---|---|
| 837584 | 5/1938 | France | 248/603 |

*Primary Examiner*—Richard A. Bertsch
*Assistant Examiner*—Roland G. McAndrews, Jr.
*Attorney, Agent, or Firm*—Konneker & Bush

[57] ABSTRACT

A centrifugal air blower has a housing with an inlet side wall through which a circular air inlet is formed. A cylindrical electric drive motor coaxially extends through the inlet opening and is drivingly coupled to a centrifugal impeller rotatably disposed within the housing. The motor is supported on the inlet side wall by a mounting system including a plurality of metal mounting rods each having an inner end, an outer end, and an elongated intermediate portion. The inner rod ends are welded to circumferentially spaced locations of a belly band structure coaxially clamped to the drive motor, and the outer rod ends are connected to resilient support assemblies arranged in a circumferentially spaced array on the outer side of the housing inlet side wall around the blower inlet opening. To provide the mounting system with a high degree of stiffness with respect to mounting system loads directed transversely to the motor drive axis, while at the same time providing the mounting system with a high degree of torsional flexibility, each of the intermediate rod portions is positioned to longitudinally extend adjacent and generally parallel to a line extending from the outer end portion of the rod to the center of gravity of the combined mass of the drive motor and impeller.

11 Claims, 4 Drawing Sheets

FAN MOTOR/IMPELLER MOUNTING SYSTEM

BACKGROUND OF THE INVENTION

The present invention generally relates to motor-driven air blowers and, in a preferred embodiment thereof, more particularly relates to apparatus for operatively supporting a drive motor and an associated impeller wheel on the housing portion of an air blower.

Centrifugal blowers of the type, for example, used to operatively flow air through forced air heating furnaces typically comprise a blower housing having an inlet side wall through which a circular air inlet opening is formed. The inlet opening is positioned over an open side of a centrifugal blower impeller positioned within the housing coaxially with the inlet opening. An electric drive motor is coaxially disposed within the impeller and has a drive shaft operatively coupled to a central portion of a closed inner side wall thereof. The cylindrical housing of the motor defines with the circular edge of the inlet opening an annulus through which air is drawn into the interior of the impeller during operation of the motor.

The motor is conventionally supported on the blower housing inlet side wall by circumferentially spaced motor mount members extending across the inlet annulus and secured at their opposite ends to the motor housing and the blower housing inlet side wall. One common prior art motor mounting technique, as shown in U.S. Pat. No. 4,759,526 to Crawford et al, is to connect three or four circumferentially spaced support legs to the outer side of the motor housing using a circularly shaped connector typically referred to as a "belly band". Typically, from their connection points on the belly band, the support legs extend axially outwardly along the motor housing to the fan housing wall. Each of the legs then bends, at generally a ninety degree angle, radially outwardly across the blower housing inlet opening and has its outer end suitably secured to the outer side of the blower housing inlet side wall.

Various problems, limitations and disadvantages have heretofore been associated with this conventional blower motor mounting system with its right angle mounting legs. For example, the relatively heavy motor/blower wheel assembly supported by the legs creates substantial bending loads in the leg portions that extend radially outwardly from the motor to the fan housing, thereby tending to undesirably deflect the legs. In order to sufficiently reduce this bending deflection more material must be added to the legs, additional legs must be added, or both. This conventional design requirement results in a more expensive mounting system, can create an undesirable increase in air inflow restriction, and a generally more rigid overall mounting system. While the more rigid mounting system lessens the bending deflection of the motor support legs, it also increases the amount of operational vibration transmitted from the motor to the blower housing, thereby undesirably increasing the operating noise of the blower.

The mounting system must support the motor/impeller assembly under two distinct loading conditions—a shipping condition and an operating condition. Typically, a furnace is shipped with the axis of its blower motor in a horizontal orientation, and the shipping loads are primarily vertically directed in both upward and downward directions. Downward transient shipping loads combine with the weight of the motor/impeller assembly to impose substantial bending loads on the radially outwardly extending portions of the conventionally configured motor support legs described above, and can cause breakage of one or more of the legs if they are not made sufficiently thick and rigid to withstand the shipping loads.

Operating loads, on the other hand place a constant bending load on the legs from the weight of the motor/impeller assembly in addition to a torsional load on the legs due to the torque of the motor, particularly during motor start-up. Attempts to oversize and stiffen the motor support legs in order for them to withstand vertical shipping loads (i.e., under the first loading condition), as mentioned above, tends to undesirably increase the transmission of vibration from the motor/impeller assembly to the blower housing during motor operation (i.e., under the second loading condition), thereby correspondingly increasing the operating noise of the blower.

It can be readily seen from the foregoing that it would be desirable to provide an improved blower motor mounting system that eliminates or at least substantially reduces the above-mentioned problems, limitations and disadvantages heretofore associated with conventional mounting systems of the general type described above. It is accordingly an object of the present invention to provide such an improved blower motor mounting system.

SUMMARY OF THE INVENTION

In carrying out principles of the present invention, in accordance with a preferred embodiment thereof, a centrifugal blower, representatively of the type used in a forced air furnace or HVAC unit, is provided with a specially designed motor/impeller mounting system that desirably provides a high degree of mounting stiffness with respect to loads borne by the mounting system in a direction transverse to the rotational drive axis of the blower, while at the same providing a high degree of torsional flexibility to substantially reduce the operating noise of the blower.

The blower includes a housing having an inlet side wall through which a circular inlet opening is formed and bordered by a peripheral edge portion of the inlet side wall. A centrifugal impeller is rotatably disposed within the housing coaxially with its inlet opening and has a rotational drive axis perpendicular to the inlet side wall. To operatively rotate the impeller a cylindrical drive motor is coaxially and drivingly coupled to the impeller and defines with the periphery of the inlet opening an annulus through which inlet air may be drawn into the impeller during drive motor operation.

The motor/impeller mounting system supports the drive motor on the housing inlet side wall and includes a plurality of elongated mounting legs each having an inner end portion, an outer end portion, and an intermediate portion extending between the inner end portion of the leg and its outer end portion. Representatively, the mounting legs are bent metal rods each lying generally in a plane. First means are provided for securing the inner end portions of the mounting legs to the cylindrical drive motor in a circumferentially spaced relationship around the rotational drive axis. Representatively, the first means include a belly band structure coaxially and releasably clamped to the drive motor. Second means are provided for securing the outer leg end portions exteriorly to the housing inlet side wall.

According to one feature of the invention, each of the intermediate mounting leg portions longitudinally extends adjacent and generally parallel to a line extending from the outer end portion of the mounting leg to the center of gravity of the combined mass of the drive motor and impeller. This substantially reduces the bending stress on the legs arising from loads on the mounting system directed transversely to the blower drive axis, such as the weight of the motor and impeller and vertical shipping loads. Due to this orientation of the mounting legs, these types of transverse mounting system forces load the intermediate mounting leg portions primarily in axial tension and compression along their lengths.

To provide the mounting system with noise-reducing torsional flexibility, the outer mounting leg ends are preferably of a looped configuration centered about outer end axes extending parallel to the inlet side wall, and the aforementioned second means are operative to resiliently support the outer mounting leg end portions on the housing inlet side wall for translational movement relative thereto along the outer end axes, and for pivotal movement relative thereto about the outer end axes. In one embodiment of the mounting legs, their torsional flexibility is further enhanced by configuring their inner end portions in a manner such that, from their connection locations on the belly band structure they extend axially inwardly past the belly band structure, toward the impeller, and then curve back in an axially outward direction before joining the intermediate mounting leg portions.

In a preferred embodiment thereof, the second means include a plurality of support assemblies, each associated with one of the looped mounting leg end portions. Each support assembly preferably includes a mounting bracket having a base tab portion exteriorly secured to the housing inlet side wall, and a support tab portion projecting transversely outwardly from the inlet side wall and having an opening therein. A resilient structure extends through and captively retains the outer mounting leg end portion and is positioned against the support tab portion of the mounting bracket. Fastening means are provided for holding the resilient structure against the support tab portion of the mounting bracket.

DETAILED DESCRIPTION

Figure 1:
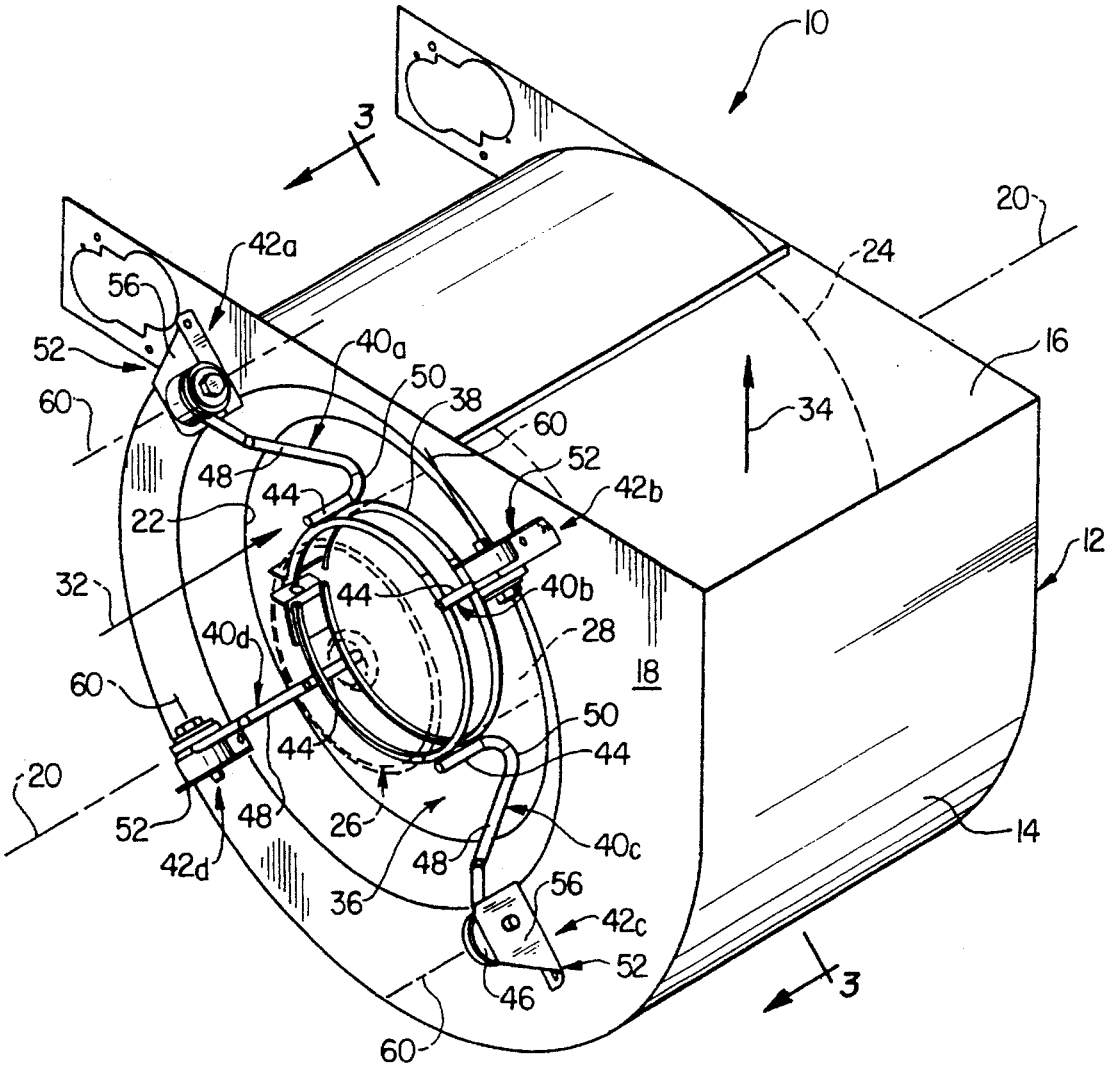
FIG. 1 is a simplified, partially phantomed perspective view of a representative furnace supply air blower having incorporated therein a specially designed motor impeller mounting system embodying principles of the present invention.

Perspectively illustrated in FIG. 1 is a centrifugal fan or blower 10 of the type typically used to force air to be heated through a forced air heating furnace (not shown). Centrifugal blower 10 includes a sheet metal housing 12 having a hollow, generally volute-shaped scroll or body portion 14 with an upwardly facing discharge opening 16. The housing body portion 14 includes an inlet side wall 18 having a generally voluted configuration around a major portion of its periphery, the generally circular portion of the wall 18 being centered about the rotational axis 20 of the blower.

A circular venturi inlet opening 22 is formed through the side wall 18 and is centered about axis 20. Coaxially positioned within the cylindrical housing body portion 14 is a conventional centrifugal blower impeller 24 having an open side facing the housing inlet opening 22, and an inner side wall (not visible).

The impeller 24 is rotationally driven about the axis 20 by an electric drive motor 26 coaxially positioned within the impeller 24 and having a cylindrical housing 28, and a drive shaft (not visible) anchored to a central portion of the impeller inner side wall. Motor-driven rotation of the impeller 24 about the axis 20 draws inlet air 32 inwardly through the annular space defined between the periphery of the inlet opening 22 and the outer side wall of the motor housing 28. Air drawn into the impeller interior is radially discharged from the impeller, into the interior of the housing portion 14, and is then discharged from the blower housing 12 through its discharge opening 16 as indicated by the arrow 34.

Drive motor 26 is operatively supported on the housing inlet side wall by a specially designed motor/impeller mounting system 36 that embodies principles of the present invention. The mounting system 36 representatively includes a generally conventional metal belly band 38 adjustably clamped around the side of the motor housing 28; four mounting legs in the form of specially configured bent metal rods 40*a*–40*d*; and four specially designed support assemblies 42*a*–42*d* secured to the outer side of the housing inlet wall 18.

Figure 2:
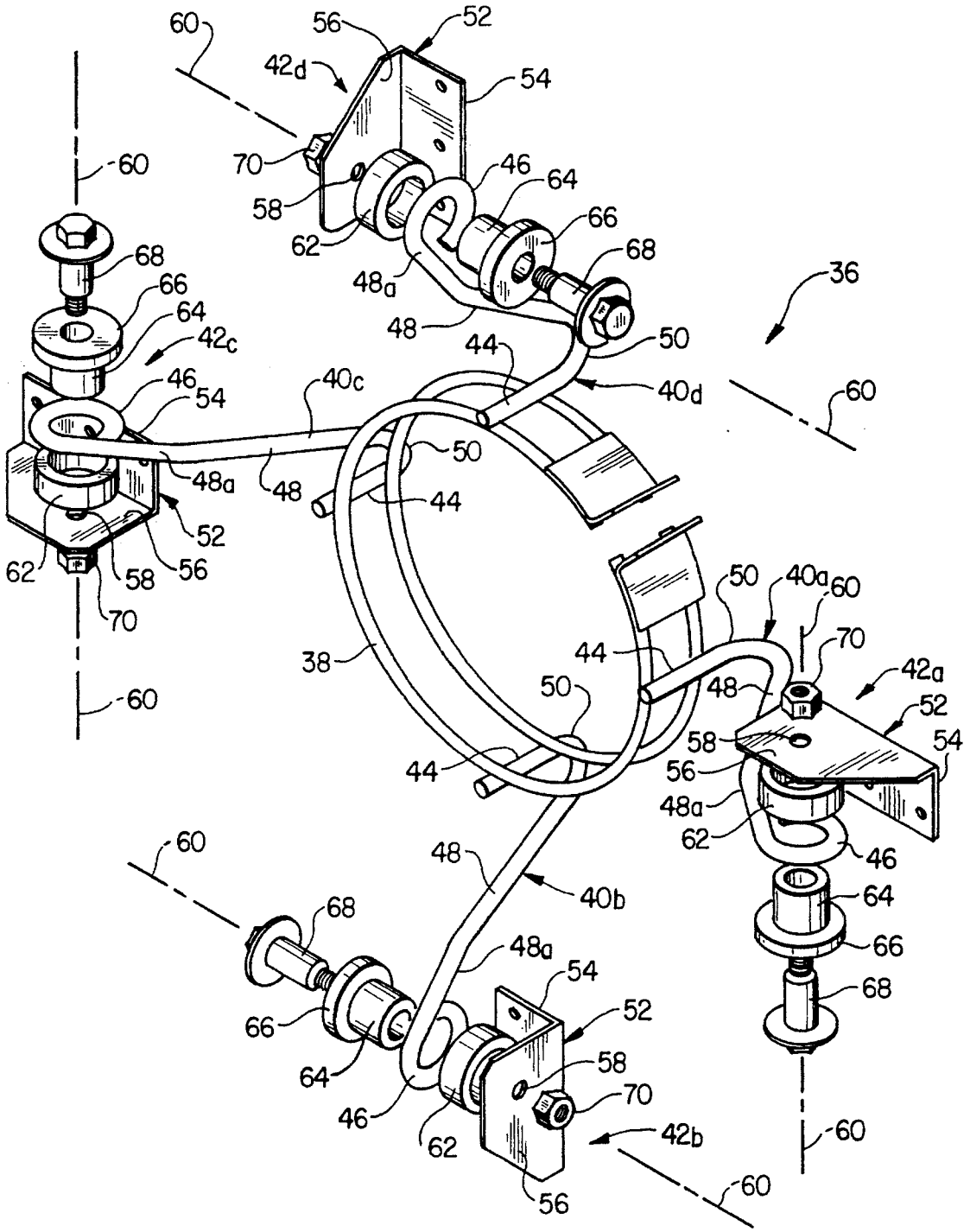
FIG. 2 is an enlarged scale exploded perspective view of the mounting system.
Figure 3:
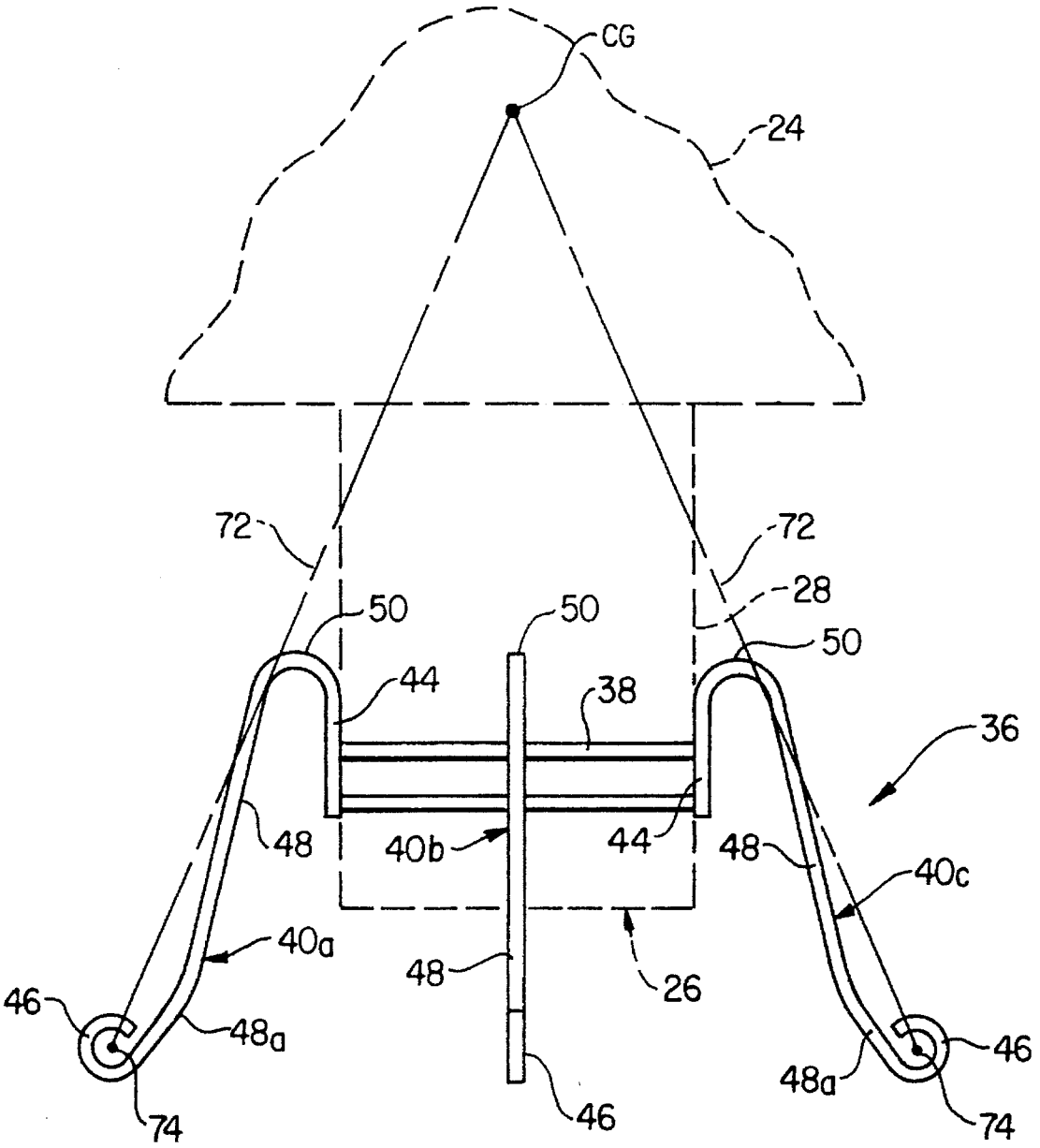
FIG. 3 is an enlarged scale, partially phantomed schematic cross-sectional view taken through the blower along line 3—3 of FIG. 1.

Referring now to FIGS. 1–3, each of the mounting legs 40*a*–40*d* is representatively about 0.25" in diameter, lies generally in a plane, and has an inner end portion 44 extending parallel to the axis of the belly band 38, a looped outer end portion 46, and an elongated intermediate portion 48. The axially extending inner end portion 44 of each mounting leg 40 is welded to the outer side of the belly band 38, and the looped outer end 46 of each mounting leg 40 is secured to one of the support assemblies 42 as later described. From its belly band attachment point, each of the inner mounting leg portions 44 extends axially inwardly past the belly band 38 (i.e., toward the impeller 24) and then curves around, as at 50, in an outward direction (i.e., away from the impeller 24) to meet the inner end of the intermediate leg portion 48.

As best illustrated in FIGS. 1 and 2, the mounting legs 40*a*–40*d* are circumferentially spaced apart from one another by 90 degrees, with the mounting legs 40*a* and 40*c* lying in a common plane canted at 45 degrees in one direction relative to vertical, and the mounting legs 40*b* and 40*d* lying in a common plane canted at 45 degrees in the opposite direction relative to vertical. Each of the mounting legs 40*a*–40*d*, from its juncture with the recurved leg portion 50, is sloped axially and radially outwardly to meet the looped outer leg end portion 46. As illustrated, an outer end portion of each intermediate leg portion 48 is outwardly angled to meet the looped outer leg end portion 46.

Turning now to FIG. 2, each of the four support assemblies 42 includes a generally L-shaped metal mounting bracket 52 having a base tab portion 54 suitably anchored to the housing inlet side wall 18, and an upstanding mounting tab 56 lying in a plane parallel to the plane of the mounting leg 40 with which the bracket 52 is associated. A circular hole 58 is formed through each of the mounting tabs 56 and is centered about an axis 60 that extends perpendicularly to the mounting tab 56, the plane of its associated mounting leg 40, and the rotational axis 20 of the motor 26 and impeller 24 (see FIG. 1).

Each of the support assemblies 42 also includes an annular elastomeric washer 62, a tubular elastomeric grommet 64 with a radially enlarged end portion 66, an elongated bolt 68, and a retaining nut 70. The looped outer ends 46 of the mounting legs 40 are each secured to one of the mounting tabs 56 by positioning the looped end 46 between the washer 62 and the grommet 64, positioning the washer against the tab 56, inserting the body portion of the grommet 64 through the looped mounting leg end 46 and the grommet 62 to captively retain the looped end 46 between the washer 62 and the grommet end portion 66, inserting the bolt 68 through the grommet 64, the looped end 46, the washer 62 and the tab opening 58, and then tightening the nut 70 onto the bolt 68.

It can be seen in FIG. 1 that, compared to conventional fan motor mounting legs, the mounting legs 40*a*–40*d* of the present invention are quite small in cross-section and do not appreciably restrict the flow of inlet air 32 into the fan housing 12 during operation of the motor 26. Despite their relatively small cross-sections, however, the mounting legs 40*a*–40*d* provide for the quite rigid support of the motor/impeller assembly with respect to loads on the legs in directions transverse to the rotational axis 20 (such as the weight of the motor/impeller assembly and vertical shipping loads borne by the legs 40*a*–40*d*). According to one aspect of the present invention this rigid mounting of the motor 26 and impeller 24 is achieved by configuring and orienting the mounting legs 40*a*–40*d* in a manner such that these vertical support loads are borne by the intermediate leg portions 48 primarily in an axial mode (i.e., in axial tension and compression), without subjecting the intermediate leg portions to substantial bending loads.

Referring now to FIG. 3, it was discovered in developing the present invention that if each of the intermediate leg portions 48 (as shown for the intermediate leg portions 48 of the mounting legs 40*a* and 40*c* in FIG. 3) is positioned precisely along a line 72 extending from the center 74 of its looped end portion 46 (the housing attachment point of the leg) through the center of gravity CG of the combined mass of the motor 26 and impeller 24, the bending stress in each of the intermediate leg portions 48 due to vertically directed weight and shipping loads is substantially eliminated.

While certain design constraints prevent the positioning of the illustrated intermediate leg portions 48 precisely along their associated lines 72 it can be seen in FIG. 3 that the intermediate leg portions 48 lie closely adjacent and generally parallel with their associated lines 72, so that vertical bending stress on the leg portions 48 is greatly reduced, with each of the lines 72 lying generally in the plane of its associated intermediate leg portion 48. Accordingly, as mentioned above, vertically directed shipping and motor/impeller weight loads are borne by the elongated intermediate leg portions 48 primarily in axial tension and compression along their lengths. The recurved portions 50 of the mounting legs 40 facilitate the positioning of the intermediate leg portions 48 adjacent and generally parallel to their associated "zero bending force" lines 72.

One of the unique features of the motor/impeller mounting system 36 of the present invention is that while it is quite rigid with respect to linear forces directed transversely to the rotational axis 20 of the blower 10, it is at the same time desirably quite flexible with respect to torsional loads about the axis 20 generated during operation of the blower 10. One of the most pronounced of these torsional loads is the torque pulse of the drive motor 26 during its operation.

Most residential furnace or HVAC blower equipment in the United States utilizes single phase, 60 Hz motors. An unavoidable characteristic of these motors is their alternating torque pulses that occur at the rate of 120 times per second. In the motor/impeller mounting system 36 of the present invention a relatively high degree of torsional flexibility, which substantially decreases the amount of motor vibration transmitted to the blower housing and thus reduces the overall blower operating noise, is provided by a combination of (1) the lengths and torsional flexibility of the mounting legs 40*a*–40*d*, (2) the recurved leg portions 50, (3) the construction and orientation of the resilient support assemblies 42*a*–42*d*, and (4) the pivotal mounting of the looped outer leg ends 46 to the support assemblies.

As can be seen in FIG. 2, each of the looped outer leg ends 46 is captively retained between a washer 62 and an opposing enlarged grommet end portion 66. Accordingly, in response to a clockwise torque on its associated mounting leg (for example, during motor start-up) an entire side of the grommet portion 66 is resiliently compressed by the facing side of the looped outer leg end 46, and in response to a counterclockwise torque on its associated mounting leg (for example, during motor shut-down) an entire side of the washer 62 is resiliently compressed by the opposite side of the looped outer leg end 46.

During torsional deflection of the mounting legs 40*a*–40*d* the looped outer end portions 46 thereof are permitted to pivot about the support assembly axes 60 to thereby reduce the torsional bending stresses borne by the legs 40*a*–40*d*. The brackets 52 serve not only to mount the outer ends of the support legs 40*a*–40*d*, but also (via the base portions 54 of the brackets 52) function to desirably stiffen the blower housing inlet side wall 18.

Figure 4:
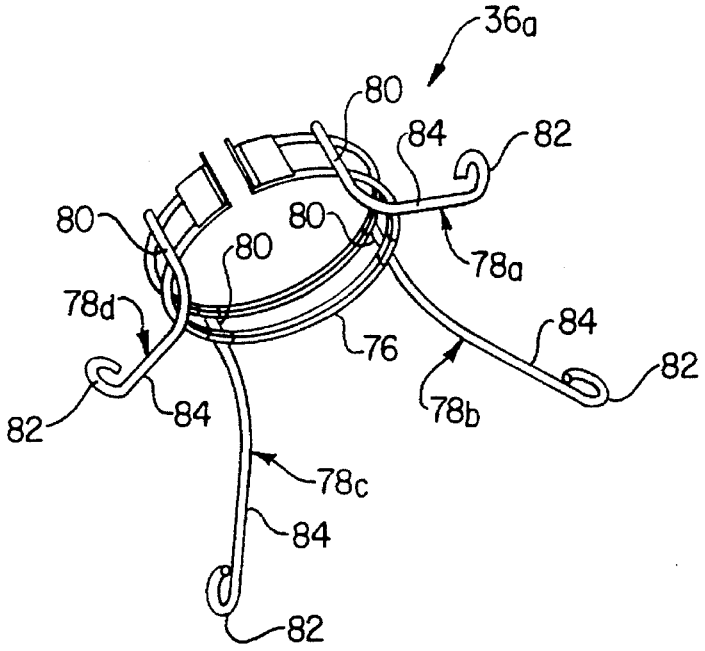
FIG. 4 is a reduced scale perspective view of a portion of an alternate embodiment of the mounting system.
Figure 5:
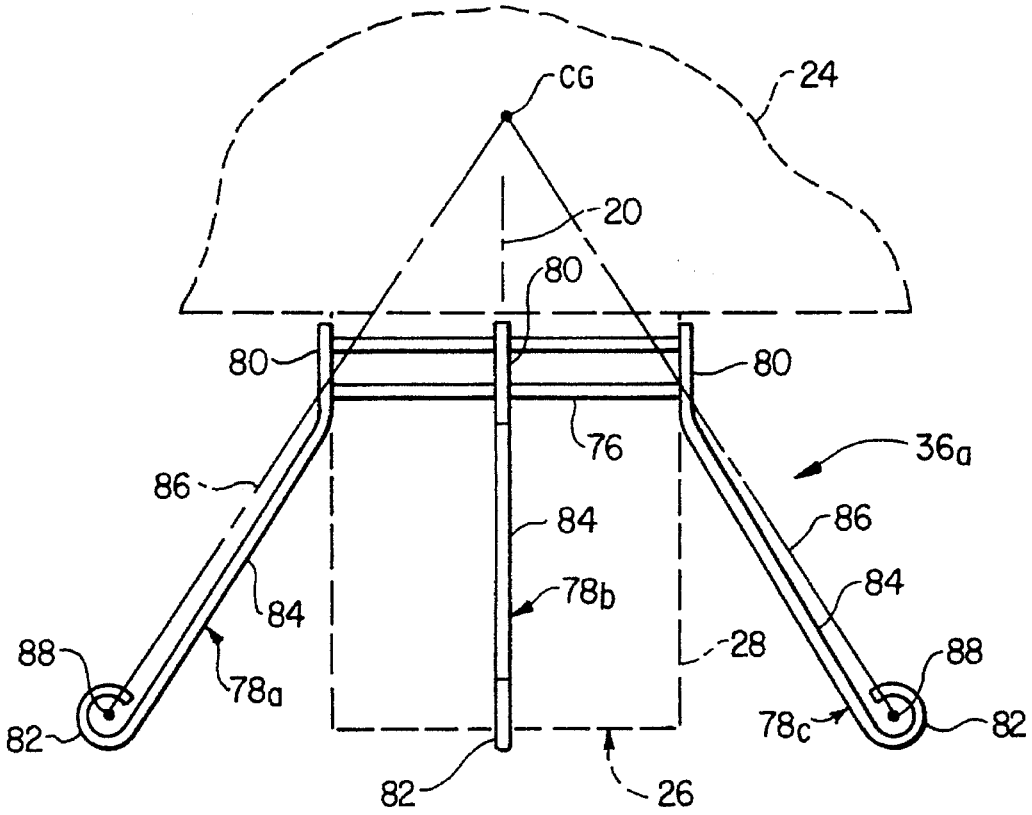
FIG. 5 is a view, similar to that in FIG. 3, of the alternate mounting system embodiment.

A belly band and mounting leg portion of an alternate embodiment 36*a* of the previously described motor/impeller mounting system 36 is illustrated in FIGS. 4 and 5 and includes a belly band 76 coaxially and releasably clamped to the motor housing 28, and four metal rod mounting legs 78*a*–78*d* circumferentially spaced around the belly band 78 at 90 degrees from one another in a manner similar to the circumferential spacing of the previously described mounting legs 40*a*–40*d*. Each of the mounting legs 78*a*–78*d* has an axially extending inner end portion 80, a looped outer end portion 82, and an essentially straight intermediate portion 84. The looped outer end portions 82 of the mounting legs 78*a*–78*d* are secured to support assemblies (not illustrated in FIGS. 4 and 5) identical to the previously described support assemblies 42.

Each of the intermediate leg portions 84 extends adjacent and generally parallel to a "zero bending force" line 86 extending between the center point 88 of its looped outer end portion 82 and the center of gravity CG of the combined mass of the motor 26 and the impeller 24. Accordingly, like the previously described intermediate leg portions 48, the intermediate mounting leg portions 84 are stressed primarily in axial directions by forces imposed on the mounting system 36*a* (such as vertical shipping loads and the weight of the motor and impeller) in directions transverse to the blower rotational axis 20. Thus, like the previously described mounting system 36, the mounting system 36*a* is quite rigid with respect to loads transverse to the axis 20, but desirably provides a substantial degree of torsional flexibility that functions to materially reduce the operational noise of the blower in which the mounting system 36*a* is incorporated.

In the mounting system 36*a* the recurved portions of the inner leg portions 80 are omitted. In order to facilitate the positioning of the intermediate leg portions 84 adjacent and generally parallel to the lines 86, the legs 78*a*–78*d* are made somewhat longer than the previously described mounting legs 40*a*–40*d* in the mounting system 36, and the belly band 76 is positioned further inwardly along the motor housing 28 than the previously described belly band 38.

The foregoing detailed description is to be clearly understood as being given by way of illustration and example only, the spirit and scope of the present invention being limited solely by the appended claims.

What is claimed is:

1. A centrifugal blower comprising:

a housing having an inlet side wall through which a circular inlet opening is formed and bordered by a peripheral edge portion of said inlet side wall;

a centrifugal blower impeller rotatably disposed within said housing coaxially with said inlet opening and having a rotational drive axis perpendicular to said inlet side wall;

a cylindrical drive motor coaxially and drivingly coupled to said impeller and defining with said peripheral edge portion of said inlet side wall an annulus through which inlet air may be drawn into said impeller; and mounting apparatus for securing said drive motor to said inlet side wall of said housing, said mounting apparatus including:

a plurality of elongated mounting legs each lying generally in a plane and having an inner end portion, an outer end portion, and an intermediate portion extending between said inner end portion and said outer end portion, each of said outer mounting leg end portions having a looped configuration centered about an outer end axis perpendicular to the plane of the mounting leg, first means for securing said inner end portions of said mounting legs to said cylindrical drive motor in a circumferentially spaced relationship around said rotational drive axis, and second means for securing said outer end portions of said mounting legs to said inlet side wall of said housing, said intermediate portion of each of said mounting legs extending adjacent and generally parallel to a line extending between the outer end portion of the mounting leg and the center of gravity of the combined mass of said impeller and said drive motor, said second means being operative to resiliently support said outer mounting leg end portions on said housing inlet side wall for translational movement relative thereto along said outer end axes, and for pivotal movement relative thereto about said outer end axes.

2. The centrifugal blower of claim 1 wherein:

each of said mounting legs is a bent metal rod.

3. The centrifugal blower of claim 2 wherein:

each of said planes is generally radially oriented relative to said cylindrical drive motor.

4. A centrifugal blower comprising:

a housing having an inlet side wall through which a circular inlet opening is formed and bordered by a peripheral edge portion of said inlet side wall;

a centrifugal blower impeller rotatably disposed within said housing coaxially with said inlet opening and having a rotational drive axis perpendicular to said inlet side wall;

a cylindrical drive motor coaxially and drivingly coupled to said impeller and defining with said peripheral edge portion of said inlet side wall an annulus through which inlet air may be drawn into said impeller; and mounting apparatus for securing said drive motor to said inlet side wall said housing, said mounting apparatus including:

a plurality of elongated mounting legs each having an inner end portion, an outer end portion, and an intermediate portion extending between said inner end portion and said outer end portion, first means for securing said inner end portions of said mounting legs to said cylindrical drive motor in a circumferentially spaced relationship around said rotational drive axis, said first means including a belly band structure coaxially and releasably clamped to said cylindrical drive motor, and means for anchoring said inner mounting leg end portions to said belly band structure at circumferentially spaced locations thereon, and second means for securing said outer end portions of said mounting legs to said inlet side wall of said housing, said intermediate portion of each of said mounting legs extending adjacent and generally parallel to a line extending between the outer end portion of the mounting leg and the center of gravity of the combined mass of said impeller and said drive motor, each of said inner mounting leg end portions, from its attachment location on said belly band structure, extending axially inwardly past said belly band structure toward said impeller, and then curving back in an axially outward direction to join the intermediate portion of the mounting leg.

5. A centrifugal blower comprising:

a housing having an inlet side wall through which a circular inlet opening is formed and bordered by a peripheral edge portion of said inlet side wall;

a centrifugal blower impeller rotatably disposed within said housing coaxially with said inlet opening and having a rotational drive axis perpendicular to said inlet side wall;

a cylindrical drive motor coaxially and drivingly coupled to said impeller and defining with said peripheral edge portion of said inlet side wall an annulus through which inlet air may be drawn into said impeller; and mounting apparatus for securing said drive motor to said inlet side wall of said housing, said mounting apparatus including:

a plurality of elongated bent metal mounting rods each having an inner end portion, an outer end portion, and an intermediate portion extending between said inner end portion and said outer end portion, first means for securing said inner end portions of said mounting rods to said cylindrical drive motor in a circumferentially spaced relationship around said rotational drive axis, and second means for resiliently securing said outer end portions of said mounting rods to said inlet side wall of said housing for translational movement relative thereto along outer end axes extending parallel to said inlet side wall, and rotational movement relative to said inlet side wall about said outer end axes, each of said intermediate portions of said mounting rods, from the inner end portion of the rod, sloping axially and radially outwardly relative to said cylindrical drive motor.

6. The centrifugal blower of claim 5 wherein:

the intermediate portion of each of said mounting rods extends adjacent and generally parallel to a line extending from the outer end portion of the mounting rod to the center of gravity of the combined mass of said impeller and said drive motor.

7. The centrifugal blower of claim 5 wherein:

each inner end portion of said plurality of mounting rods, from its connection location on said drive motor extends toward said impeller and then curves back away from said impeller and joins the intermediate portion of the mounting rod.

8. The centrifugal blower of claim 5 wherein:

said first means include a belly band structure coaxially and releasably clamped to said drive motor, and said inner end portions of said plurality of mounting rods are welded to said belly band structure at circumferentially spaced apart locations thereon.

9. The centrifugal blower of claim 8 wherein:

each of said outer mounting rod end portions has a looped configuration, and said second means include a plurality of support assemblies, each associated with one of said outer mounting rod end portions and including:

a mounting bracket having a base tab portion exteriorly secured to said inlet side wall, and a support tab portion projecting transversely outwardly from said inlet side wall and having an opening therein, a resilient structure extending through and captively retaining the outer mounting rod end portion and positioned against a side of the support tab portion of the mounting bracket, and fastening means for holding said resilient structure against the support tab portion of the mounting bracket.

10. The centrifugal blower of claim 9 wherein each of said resilient structures includes:

an elastomeric washer having a side positioned against the support tab portion of the mounting bracket, and an elastomeric grommet having a tubular body extending through the looped outer end portion of the mounting rod and into said washer, and an enlarged end, the looped outer end portion of the mounting rod being captively retained on said tubular grommet body between said washer and said enlarged end of said grommet.

11. The centrifugal blower of claim 10 wherein said fastening means include:

a bolt axially extending through said grommet, said washer and said support tab opening, and a nut positioned on the side of the support opposite from the washer and threaded onto an end of said bolt.

* * * * *